US006924466B2

(12) United States Patent
Lee

(10) Patent No.: US 6,924,466 B2
(45) Date of Patent: Aug. 2, 2005

(54) METHOD AND DEVICE FOR HEATER CONTROL IN DRYING APPARATUS

(75) Inventor: Soon Jo Lee, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 10/296,821

(22) PCT Filed: Mar. 29, 2002

(86) PCT No.: PCT/KR02/00552

§ 371 (c)(1),
(2), (4) Date: Nov. 27, 2002

(87) PCT Pub. No.: WO02/079561

PCT Pub. Date: Oct. 10, 2002

(65) Prior Publication Data

US 2003/0127449 A1 Jul. 10, 2003

(30) Foreign Application Priority Data

Mar. 29, 2001 (KR) ..... 2001-16564

(51) Int. Cl.[7] ..... H05B 3/02
(52) U.S. Cl. ..... 219/483; 219/482
(58) Field of Search ..... 219/483, 482, 219/484–492

(56) References Cited

U.S. PATENT DOCUMENTS

| | | | | |
|---|---|---|---|---|
| 3,942,265 A | * | 3/1976 | Sisler et al. | 34/527 |
| 4,675,511 A | | 6/1987 | Sherrill | |
| 5,249,255 A | | 9/1993 | Fuqua et al. | |
| 5,329,098 A | | 7/1994 | Howard et al. | |
| 5,895,597 A | | 4/1999 | Sherrill | |
| 5,925,273 A | | 7/1999 | Sherrill | |

FOREIGN PATENT DOCUMENTS

| | | |
|---|---|---|
| JP | 7328290 | 12/1995 |
| JP | 9024198 | 1/1997 |
| KR | 1994-0015072 | 7/1994 |
| KR | 1994-0018519 | 8/1994 |

* cited by examiner

*Primary Examiner*—Thor S. Campbell
(74) *Attorney, Agent, or Firm*—McKenna Long & Aldridge LLP

(57) ABSTRACT

A device and method for controlling a heater of a drying machine is disclosed, which includes a plurality of switches, each switch having a plurality of input terminals being supplied with different input voltages and an output terminal, and each switch connecting any one of the input terminals with the output terminal according to a switching control signal, and a heater connected to the output terminal of each switch and varying its temperature according to the voltage being supplied therein.

17 Claims, 3 Drawing Sheets

| Temp Control | Heater 1 | Heater 2 |
|---|---|---|
| ▷ High | 240V | 240V |
| ↑ | 240V<br>120V | 240V<br>120V |
| ▷ Medium | 120V | 120V |
| ↓ | 240V<br>Off | Off<br>240V |
| ▷ Low | 120V<br>Off | Off<br>120V |
| | Off | Off |

METHOD AND DEVICE FOR HEATER CONTROL IN DRYING APPARATUS

This application claims the benefit of Korean Patent Application No. P2001-16564, filed on Mar. 29, 2001, which is hereby incorporated by reference for all purposes as if fully set forth herein.

BACKGROUND OF THE INVENTION

1. Field of the Invention

The present invention relates to a device for controlling a heating device, and more particularly, to a method and a device for controlling a heater of a drying machine ("dryer").

2. Discussion of the Related Art

The development in semiconductor technology and related scientific fields has influenced many technologies affecting everyday life. Semiconductor technology is now available for use in multimedia applications including applications such as televisions and refrigerators associated with the internet, as well as sophisticated washing machines with associated drying machines.

With the advent of such changes, consumers have become more interested in energy efficiency of such appliances. More specifically, a consumer rates the reliability and quality of the product depending on its level of energy efficiency and the level of reliability of its components. Furthermore, government standards exist for energy efficiency levels. Thus, the products that do not meet specified energy efficiency standards cannot be sold in the market.

Therefore, manufacturers and distributors may only sell those products that conform to the energy efficiency standards recommended by the government. Also, consumers are more likely to have a positive attitude or feel more satisfied about their purchase because it is an environmentally conscious investment.

Specifically, the present invention relates to enhancing energy efficiency and product reliability in a device for controlling a drying machine heater.

A process of operating a dryer in the related art will be described with respect to FIG. 1. As shown in FIG. 1, an outer casing or enclosure 1 forms the outer shape of the drying machine. A front plate 3 is connected and fixed on the outer casing or enclosure 1, so as to form the front surface of the drying machine.

A drum 5 is fixed inside the outer casing or enclosure 1, so as to rotate during the course of a drying process. Wet laundry is introduced to the drum 5 prior to a drying cycle. A plurality of stirring blades or agitators 6 are located inside the drum 5. The stirring blades or agitators 6 stir the laundry while the drum 5 rotates. A belt 7 is located about the circumference of the drum 5 to facilitate rotation of drum 5. A separate motor operates the belt 7, which drives the drum 5.

Door 8 connects the inside and the outside of the drum 5 and penetrates the front plate 3, which corresponds to the front portion of the drum 5. Discharge hole 10 corresponds to the inside of the front plate 3 and opens towards the inside of the drum. The discharge hole 10 discharges the air existing inside the drum 5 to the outside. A filter 12 is associated with discharge hole 10 to remove impurities within the air.

A discharge flow tube 13 connected to the discharge hole 10 is located behind the front plate 3. A blower assembly 15 is in fluid connection with the discharge flow tube 13. A discharge duct 17 in conjunction with blower assembly 15 discharges the air, which flows through the discharge flow tube 13 to the outside of the drying machine.

Additionally, a supply duct 18 supplying air into the drum is located in a lower portion of the drum 5 inside the outer casing or enclosure 1. The supply duct 18 supplies air for the drum 5 through the rear side of the drum 5. A heater 19 is located adjacent to supply duct 18.

Current heaters for drying machines may operate in various ways. In one method, a user opens the door 8 and puts wet laundry into the drum 5 of the drying machine. After the door 8 is closed, the user selects the desired settings or inputs operation signals. Then the temperature settings are selected and a motor rotates drum 5. Subsequently, the blower assembly 15 is activated and forces or discharges the air inside the drum 5 through the discharge duct 17.

While the air inside the drum 5 is discharged, the ambient air outside the drying machine is drawn into the drum 5 through the supply duct 18. Heater 19 is located at the opening of the supply duct 18, and heats the air flowing through supply duct 18 from outside the drying machine to a set temperature. The heated air is then drawn into the drum 5.

The heated air inside the drum 5 absorbs the humidity associated with the wet laundry. Blower assembly 15 operates to circulate air through the discharge hole 10 into the discharge flow tube 13. The humid air inside the discharge flow tube 13 then flows through the blower assembly 15 and the discharge duct 17 in order to be discharged to the outside.

The filter 12 filters the air flowing through the discharge hole, so as to prevent impurities, such as drawn thread, fuzz, or lint, from entering the blower assembly 15.

Another method for controlling a drying machine heater includes a thermistor 24 fixed inside the drum 5. Thermistor 24 is fixed inside the drum and detects the temperature within the drum. Controller 20 then uses the detected temperature to control a series of operations related to the drying process of the drying machine. The controller 20 is connected to a first terminal L1 and a second terminal N, both supply of which supply voltage to the drying machine. A driving voltage of about 120V is supplied to the controller 20, which is connected to the first terminal L1 and the second terminal N.

In addition, other existing drying machines are equipped with a heater 19 that operates on a strict ON/OFF basis controlled by the controller 20. In these drying machines, the heater 19 is connected between the first terminal L1 and a third terminal L2, both of which supply voltage to the drying machine as illustrated in FIG. 2.

The connection to the first terminal L1 and the third terminal L2 provides a voltage of about 240V to the heater 19. To prevent the heater from overheating, a thermostat 26 is connected in series with the heater 19 for automatic turn-off when the temperature reaches a set level.

The process of controlling a heater of the related art drying machines will now be described in detail.

FIG. 3 is a graph that shows temperature settings or characteristics for different types of fabric. Heaters in currently existing drying machines control the heat according to fabric type as shown in FIG. 3. For example, the temperature should be a set temperature T1 when drying cotton fabric. Also, when drying knitted fabric, the temperature inside the drum 5 should be set or controlled to another temperature T3, which is lower than the temperature setting for cotton fabric.

Therefore, the controller 20 selects or identifies the control temperature of the laundry put into the drum 5 prior to the drying process or cycle, or prior to controlling the drying process or cycle. The controller 20 sets the control temperature to an appropriate level either when the user selects the type of fabric or when the information corresponding to the fabric of the laundry is received from the washing machine.

Subsequently, when the heater 19 is turned ON and the drying operation begins accordingly, the controller 20 identifies the temperature inside the drum 5 by using the thermistor 24. Heater 19 remains ON until the inside of the drum 5 reaches the pre-set temperature range, and then the heater is turned OFF. Therefore, the heater may be turned on or off multiple times during a cycle to maintain the inside of the drum 5 within the pre-set temperature range.

The above described systems related to drying machine temperature control have many disadvantages.

In methods where a heater 19 is connected to a first terminal L1 and a third terminal L2, both of which supply voltage to the heater, the voltage is supplied such that a constant amount of power, about 240V, is always supplied to the heater 19. These heaters 19 may only be controlled in two settings in accordance with the temperature detected from the thermistor 24 and the range of temperature pre-set from the thermistor 24. Therefore, the frequent ON/OFF control of the heater results in a decrease in energy efficiency.

Additionally, when using this method of drying machine heat control, a frequent control of the ON/OFF operation is inevitable to maintain the temperature at a low level. This fatigues the heater switching device, therefore causing premature failure, thereby decreasing the reliability of the product.

SUMMARY OF THE INVENTION

Accordingly, the present invention is directed to a method and device for controlling the heater associated with a drying apparatus that substantially obviates one or more of the problems due to limitations and disadvantages of the related art.

An advantage of the present invention is to provide a heater for a drying machine with an output that may be variably controlled by using different levels of input voltage.

Another advantage of the present invention is to provide a heater for a drying machine that may be variably controlled by using different levels of input voltage where the temperature setting for a drying operation is pre-set depending on the type of fabric that is to be dried.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention relates to a device for controlling a heater for a drying machine including a plurality of switches, where each switch has a plurality of input terminals being supplied with different input voltages and an output terminal, and where each switch connects to any one of the input terminals with the output terminal according to a switching control signal; and also includes a heater connected to the output terminal of each switch varying the temperature of the heater according to the input voltage being supplied.

In another aspect of the present invention, a device for controlling a heater for a drying machine is provided and includes a plurality of switches, each switch having a plurality of input terminals being supplied with different input voltages and an output terminal, and each switch being adapted to connect any one of the input terminals to the output terminal according to a switching control signal, a plurality of heaters, each corresponding to each switch and varying its temperature according to an input voltage supplied thereto by each switch, where each heater includes a first end and a second end, where the first end is connected to an output terminal of a switch, and the second end is connected to the second switch of an adjacent heater; and a controller controlling connections of the switches, where the controller determines an output voltage of each heater depending on a desired temperature of a drying object corresponding to each laundry type, and where the controller controls the input voltage being supplied to each heater.

In another aspect of the present invention, a method is provided for controlling a heater for a drying machine by determining a range of temperatures for a heater according to each type of laundry and an output voltage according to the range of temperatures, selecting a type of laundry to be dried, identifying an output voltage of the heater corresponding to the selected type of laundry; and controlling an input voltage being supplied to the heater according to the identified output voltage.

In still another aspect of the invention, a device is provided for controlling a heater of a drying machine including first and second switches, each switch having first and second input terminals being supplied with different input voltages and an output terminal, and each switch connecting either one of the first and second input terminals to the output terminal according to a switching control signal, a first heater connected to the output terminal of the first switch and varying its temperature according to a first input voltage supplied thereto by the first switch, a second heater connected to the output terminal of the second switch, and varying its temperature according to the second input voltage supplied thereto by the second switch, where each heater includes a first end and a second end, so that the first end of each heater is connected to the output terminal of the switch, and the second end of each heater is commonly connected to one another; and a controller controlling the connection between the first and second switches, wherein the controller determines an output voltage of each of the first and second heaters depending on a desired temperature of a drying object corresponding to each laundry type and controls the input voltage being supplied to each of the first and second heaters.

To further achieve these and other advantages and in accordance with the purpose of the present invention, a method for controlling a heater of a drying machine according to the present invention includes deciding a range of temperatures for a heater according to each type of laundry and an output voltage according to the range of temperatures, selecting the type of laundry to be dried, identifying an output voltage of the heater corresponding to the selected type of laundry, and controlling an input voltage being supplied to the heater according to the identified output voltage.

As described above, the input voltage of the heater is variably controlled, so as to variably control the output voltage of the heater according to the range of temperatures.

Therefore, as in the related art, frequent ON/OFF operations of the heater at a low temperature range may be prevented, thereby enhancing a reliability of components in the heater and switching device.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to an embodiment of the present invention, example of which is illustrated in the accompanying drawings. In describing the identical structures of the present invention, the same terms and numeric references will be used and some supplemental descriptions will be omitted for simplicity.

Figure 1:
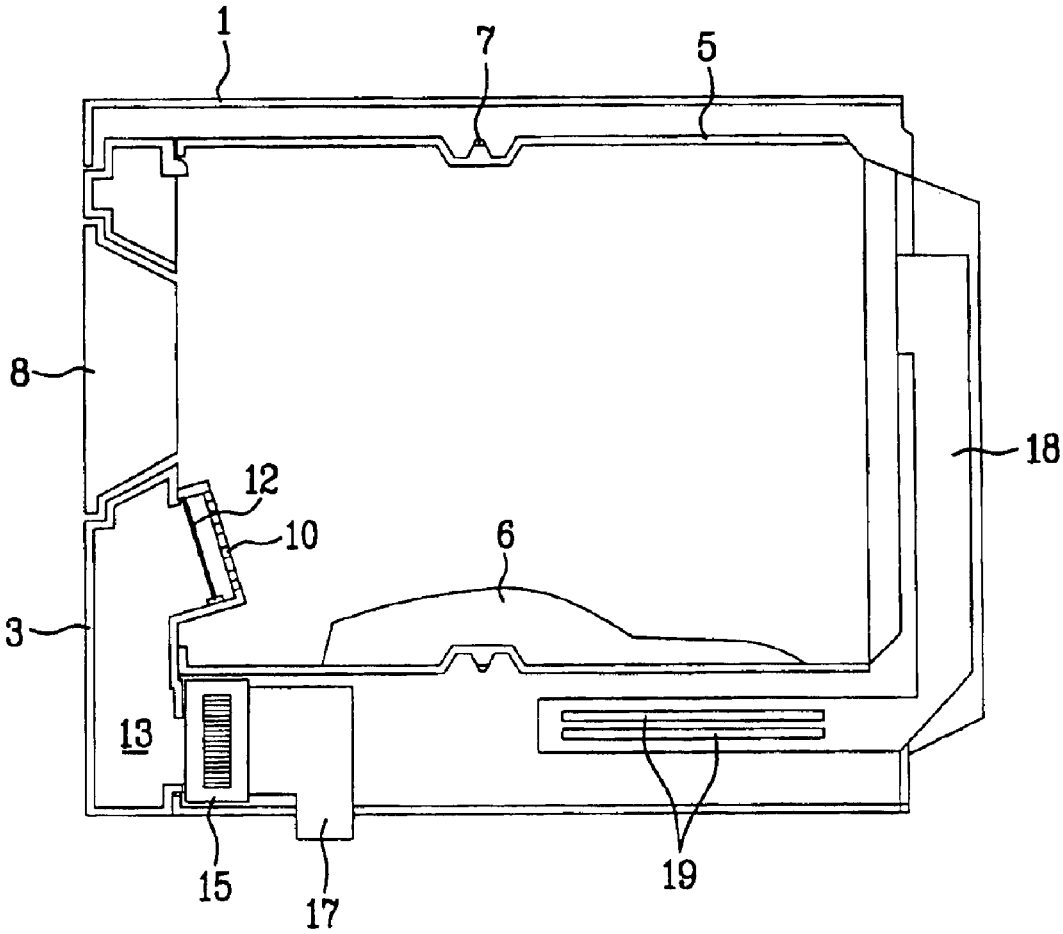
FIG. 1 illustrates a structure of a general drying machine.
Figure 2:
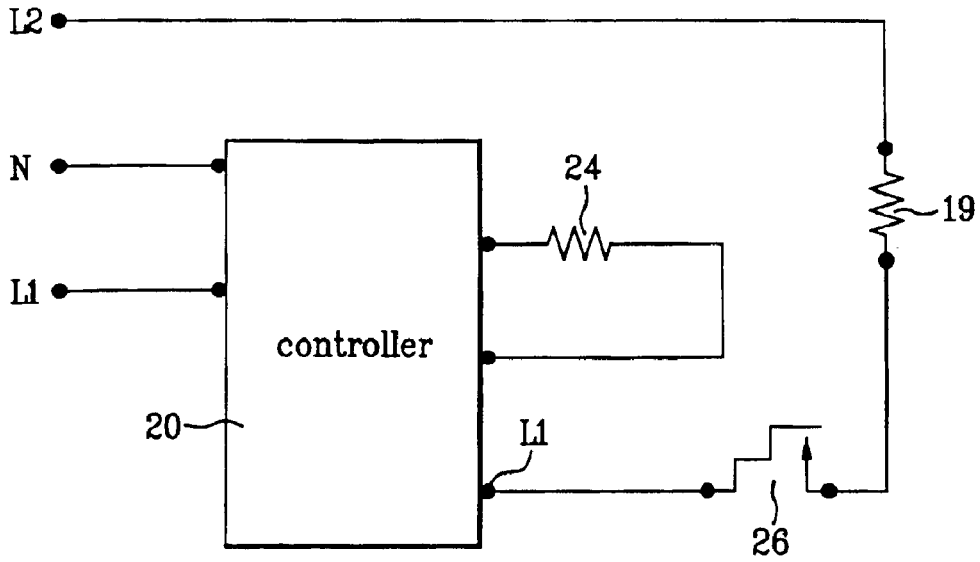
FIG. 2 illustrates a block diagram showing a device for controlling a heater of the related art drying machine.
Figure 3:
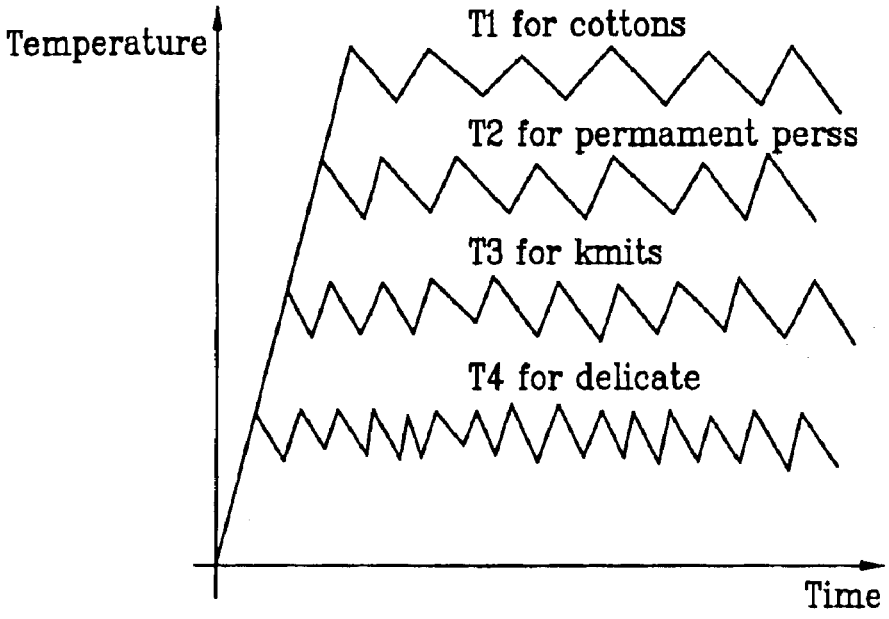
FIG. 3 illustrates a graph showing temperature characteristics according to each type of fabric.
Figures 4, 5:
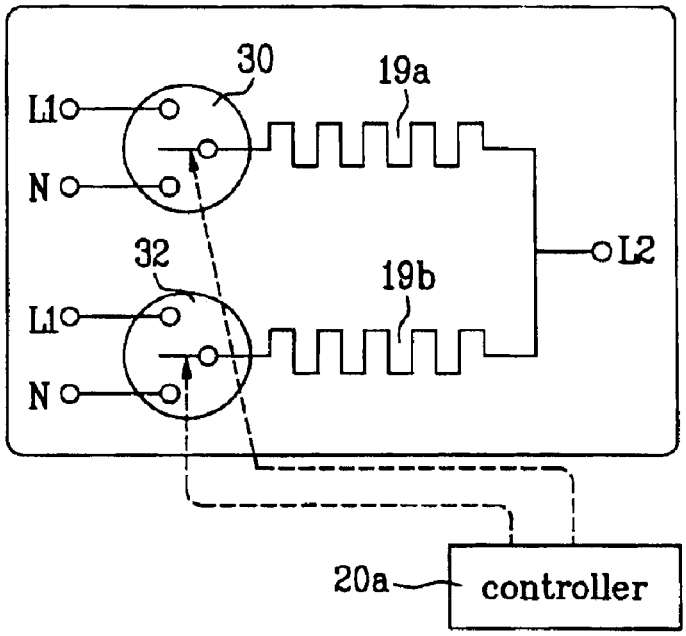
FIG. 4 illustrates a block diagram of a device for controlling a heater of a drying machine according to the present invention
FIG. 5 illustrates a control table of the heater according to the present invention.

FIG. 4 illustrates a block diagram of a device for controlling a heater of a drying machine according to the present invention. The structure of the heater will be made with reference to FIG. 1.

A device for controlling a heater according to the present invention includes two heaters 19*a* and 19*b* connected in parallel. The drying operation is controlled by the heaters 19*a* and 19*b* via the supply voltage.

One side of the first heater 19*a* is connected to a third terminal L2, which supplies an input voltage to the drying machine. Another side of the heater 19*a* is connected to a first relay 30 allowing a selective connection with either a first terminal L1 and a second terminal N, both of which supply input voltages into the drying machine. Therefore, the heater 19*a* may be connected between the first terminal L1 and the third terminal L2 through the first relay 30. In other embodiments, the first heater 19*a* may be connected between the second terminal N and the third terminal L2 through the first relay 30.

The second heater 19*b* may have a structure similar to that of the first heater 19*a*. Specifically, one side of the second heater 19*b* is connected to a third terminal L2, which supplies an input voltage to the drying machine. Another side of the second heater 19*b* may be connected to a second relay 32 allowing a selective connection to either a first terminal L1 and a second terminal N, both of which supply input voltages to the drying machine. Therefore, the second heater 19*b* may be connected between the first terminal L1 and the third terminal L2 through the second relay 32. In another embodiment, the second heater 19*b* may be connected between the second terminal N and the third terminal L2 through the second relay 32.

In one embodiment of the present invention, a controller 20*a* preferably controls the operation of the first and second relays 30 and 32. The controller 20*a* determines a temperature control setting according to the type of fabric being laundered. The controller 20*a* then controls the operation of the first and second relays 30 and 32, thereby enabling the voltage output of the heater according to the desired temperature setting or temperature control range.

First and second relays 30 and 32 are controlled according to the controller temperature setting, as shown in FIG. 5. Specifically, when the temperature should be set to a higher temperature range, a high output control is executed in the first and second heaters 19*a* and 19*b*. However, when the temperature setting should be set to a lower temperature setting, a low output control is carried out in the first and second heaters 19*a* and 19*b*.

Therefore, the controller 20*a* pre-sets a value for an output control of the heater according to the temperature setting, as shown in FIG. 5. Corresponding control of the output voltage of the first and second heaters 19*a* and 19*b* is possible because the input voltage may be one of three levels: 0 V, 120V, and 240V.

The above-described device and method for controlling a heater for a drying machine according to the present invention will now be described in detail.

A user opens the door 8 to the drying machine and places a load of wet laundry into the drum 5 and shuts the door 8. Next, the user inputs the drying operation signal, which is recognized by the controller 20*a*. The controller 20*a* activates the motor, thereby allowing the drum 5 to rotate. Then, the blower assembly 15 is activated, discharging the air within the drum 5 through the discharge duct 17 to the outside.

Meanwhile, the controller 20*a* determines a temperature setting or temperature control range for the drying cycle based on the type of laundry fabric that was selected by the user or the laundry fabric information provided by the washing machine. When drying laundry that can be processed at a higher temperature range, the output voltage of the first and second heaters 19*a* and 19*b* may be set or controlled to a higher level. Conversely, when drying laundry that should be processed at a lower temperature range, the output voltage of the heaters 19*a* and 19*b* may be controlled to a lower level.

Thus, in order to carry out a drying operation or cycle within the desired temperature setting, the controller 20*a* controls the switching operation of the first and second relays 30 and 32, thereby enabling the first and second heaters 19*a* and 19*b* to generate heat.

During a drying cycle, the air within the drum 5 is discharged to the outside, while cool air is drawn in from the outside through the supply duct 18 and to drum 5. Because the first and second heaters 19*a* and 19*b* are located on the opening of each supply duct 18, the air drawn into the drum is heated to a certain degree.

The heated air supplied to the drum 5 removes moisture from the laundry and is sent through the discharge hole 10 to the discharge flow 13 by the blower assembly 15. The air is then externally discharged from the discharge flow 13 and through the discharge duct 17. Thus, the circulating movement of heated air allows the wet laundry inside the drum 5 to be dried.

The process of controlling the level of voltage supplied to the first and second heaters 19*a* and 19*b* will now be described in detail.

As shown in FIG. 4, a single-phase 3-wire type connection may include a total of three terminals for supplying input voltage (i.e., the first terminal L1, the second terminal N, and the third terminal L2). Each of the three terminals is designed to generate different levels of voltage when connected to one another. When the first terminal L1 is connected to the second terminal N, a voltage of about 120V is produced. Similarly, when the second terminal N is connected to the third terminal L2, a voltage of about 120V is generated. Finally, when the first terminal L1 is connected to the third terminal L2, a voltage of 240V is produced.

Therefore, in the present invention, the output voltage of the heater may be variably controlled by using different levels of input voltage. In an embodiment in which the input voltage is constant, a structure for transforming current is also included to allow control of the input voltage of the heater.

Specifically, both the first relay 30 and the second relay 32 are designed to select either the first terminal L1 and the second terminal N. In addition, the third terminal L2 may be commonly connected to the side of both the first and second heaters 19*a* and 19*b*. Therefore, heaters 19*a* and 19*h* may be supplied with either a voltage of 120V or a voltage of 240V, depending upon the configuration of the first relay 30 and the second relay 32.

When the controller 20*a* connects the first relay 30 and the second relay 32 to the first terminal L1, both heaters 19*a* and 19*b* are connected between the first terminal L1 and the third terminal L2. Therefore, a voltage of 240V is supplied to operate the first and second heaters 19*a* and 19*b*.

When the controller 20*a* connects the first relay 30 to the first terminal L1 and the second relay 32 to the second terminal N, then the first heater 19*a* is supplied or operated with an input voltage of 240V, and the second heater 19*b* is supplied or operated with an input voltage of 120V. In an alternative embodiment, the controller 20*a* may connect the first relay 30 to the second terminal N and the second relay 32 to the first terminal L1, supplying or operating first heater 19*a* with an input voltage of 120V, and supplying or operating second heater 19*b* with an input voltage of 240V.

In an embodiment in which controller 20*a* connects both the first relay 30 and the second relay 32 to the second terminal N, then both heaters 19*a* and 19*b* are connected between the second terminal N and the third terminal L2. Therefore, the two heaters 19*a* and 19*b* are supplied with an input voltage of 120V.

In an embodiment in which controller 20*a* connects the first relay 30 to the first terminal L1 and turns the second relay 32 OFF, then the first heater 19*a* is connected to the first terminal L1 and the third terminal L2. Therefore, the first heater 19*a* is supplied or operated with a voltage of 240V. In this case, the second heater 19*b* is not supplied or operated with any voltage, i.e., it is off.

In an alternative embodiment, controller 20*a* may turn the first relay 30 off and may connect the second relay 32 to the first terminal L1, then the second heater 19*b* is supplied or operated with a voltage of 240V. In this embodiment, the first heater 19*a* is not supplied or operated with any voltage, i.e., it is off.

Additionally, when the controller 20*a* connects the first relay 30 to the second terminal N and turns the second relay 32 off then a driving voltage of 120V is supplied to or operates the first heater 19*a*. At this point, the second heater 19*b* is not supplied with any voltage, i.e., it is turned off. In an alternative embodiment, when the controller 20*a* turns the first relay 30 OFF and connects the second relay 32 to the second terminal N, then a driving voltage of 120V is supplied to or operates second heater 19*b*. In this case, the first heater 19*a* is not supplied or operated with any voltage, i.e., it is off.

Furthermore, when the controller 20*a* turns both the first and second relays 30 and 32 off, both heaters 19*a* and 19*b* are also turned off accordingly.

As described above in the present invention, the temperature setting or temperature control range for a drying operation or cycle is pre-set depending on the type of fabric that is to be dried. The output voltage of the heater is determined based on the pre-set temperature setting. Then, once the drying operation or cycle is initiated, an appropriate output voltage is selected in accordance with the pre-set temperature setting or temperature control range.

As described above, the device and method for heater temperature control in a drying machine according to the present invention may variably control the input voltage of a heater, thereby allowing an output voltage of the heater to be variably controlled in accordance with a temperature setting or temperature control range.

The present invention is advantageous in that frequent on/off operations of the heater at a low temperature range may be prevented. Thus, the reliability in the components of the heater and the switching device may be improved.

In addition, the output voltage of the heater according to a set temperature range may be variably controlled even without the frequent ON/OFF operations of the heater, enhancing the energy efficiency.

Finally, with the above-described advantages, reliability, product quality, and product life may also be enhanced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A device for controlling a heater of a dryer comprising:

a plurality of switches, each switch having a plurality of input terminals supplied with different input voltages and an output terminal, and each switch being adapted to connect any one of the input terminals to the output terminal according to a switching control signal;

a plurality of heaters, each heater corresponding to a respective one of the plurality of switches and wherein its temperature varies as a function of an input voltage supplied thereto through the respective switch, wherein each heater includes a first end and a second end, wherein the first end is connected to an output terminal of the respective switch, and the second end is connected to another one of the plurality of switches associated with an adjacent heater; and a controller controlling the switches, wherein the controller determines an output voltage of each heater depending on a desired temperature of a drying object corresponding to a laundry type, wherein said controller controls the input voltage being supplied to each heater.

2. The device of claim 1, wherein the plurality of heaters face each other.

3. The device of claim 1, wherein each of the plurality of switches comprises two input terminals.

4. The device of claim 3, wherein input voltages supplied to each of the two input terminals are different.

5. A device of claim 4, wherein the input voltage is one of 0 V, 120V, and 240V.

6. A device for controlling a heater of a dryer comprising:

a plurality of switches, wherein each switch has a plurality of input terminals supplied with different input voltages and an output terminal, and wherein each switch connects to any one of the input terminals with the output terminal according to a switching control signal; and a plurality of heaters, each heater connected to the output terminal of a respective one of the plurality of switches, an output temperature of the heater varying according to the input voltage being supplied thereto.

7. The device of claim 6, wherein the heaters connected to each of the switches are connected in parallel.

8. The device of claim 6, wherein a voltage is supplied to each of the plurality of input terminals and is one of 0 V, 120V, and 240V.

9. The device of claim 6, further comprising a controller controlling the plurality of switches in accordance with a desired temperature setting for a drying object.

10. A device for controlling a heater of a dryer comprising:

first and second switches, each switch having first and second input terminals supplied with different input voltages and an output terminal, and each switch connecting either one of the first and second input terminals to the output terminal according to a switching control signal;

a first heater connected to the output terminal of the first switch and wherein its temperature varies as a function of a first input voltage supplied thereto by the first switch;

a second heater connected to the output terminal of the second switch, and wherein its temperature varies as a function of a second input voltage supplied thereto by the second switch, wherein each heater includes a first end and a second end, so that the first end of each heater is connected to the output terminal of a respective one of the first and the second switches, and the second end of each heater is connected to one another; and a controller controlling the first and second switches, wherein the controller determines an output voltage of each of the first and second heaters in response to a desired temperature of a drying object corresponding to each laundry type and controls the input voltage being supplied to each of the first and second heaters.

11. The device of claim 10, wherein the first and second heaters to face one another.

12. The device of claim 10, wherein a voltage of 240V is supplied to the first input terminal, and a voltage of 120V is supplied to the second input terminal.

13. A device for controlling a heater for a dryer comprising:

a plurality of switches, each switch having a plurality of input terminals supplied with different input voltages and an output terminal, and each switch being adapted to connect any one of the input terminals to the output terminal according to a switching control signal;

a plurality of heaters, each corresponding to a respective switch and wherein its temperature varies as a function of an input voltage supplied thereto by each switch, wherein each heater includes a first end and a second end, wherein the first end is connected to an output terminal of a respective one of the plurality of switches, and the second end is connected to another switch associated with an adjacent heater, wherein the heaters connected to each of the switches are connected in parallel and face each other; and a controller controlling connections of the switches, wherein the controller determines an output voltage of each heater depending on a desired temperature of a drying object corresponding to each laundry type, wherein said controller controls an input voltage being supplied to each heater, wherein said input voltage is one of 0 V, 120V, and 240V.

14. The device of claim 13, wherein a voltage of 240 V is supplied to the first input terminal and a voltage of 120 V is supplied to the second input terminal.

15. A method for controlling a heater of a dryer of claim 1 comprising:

determining a range of temperatures for the heater according to each type of laundry and an output voltage according to the range of temperatures;

selecting a type of laundry to be dried;

identifying an output voltage of the heater corresponding to the selected type of laundry; and controlling an input voltage being supplied to the heater according to the identified output voltage, wherein said controlling further comprises providing a connection between the plurality of switches.

16. The method of claim 15, wherein said input voltage is one of 0 V, 120V, and 240V.

17. The method of claim 15, further comprising supplying a voltage of 240 V to the first input terminal and supplying a voltage of 120 V to the second input terminal.

* * * * *